US009716345B2

(12) United States Patent
Watkins

(10) Patent No.: US 9,716,345 B2
(45) Date of Patent: Jul. 25, 2017

(54) RADIO FREQUENCY (RF) SHIELD FOR MICROCOAXIAL (MCX) CABLE CONNECTORS

(71) Applicant: PPC Broadband, Inc., East Syracuse, NY (US)

(72) Inventor: Harold J. Watkins, Chittenango, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 14/576,302

(22) Filed: Dec. 19, 2014

(65) Prior Publication Data

US 2015/0180183 A1 Jun. 25, 2015

Related U.S. Application Data

(60) Provisional application No. 61/919,149, filed on Dec. 20, 2013, provisional application No. 62/040,668, filed on Aug. 22, 2014.

(51) Int. Cl.

| | |
|---|---|
| ***H01R 13/6581*** | (2011.01) |
| ***H01R 9/05*** | (2006.01) |
| ***H01R 13/6582*** | (2011.01) |
| *H01R 103/00* | (2006.01) |
| *H01R 24/56* | (2011.01) |
| *H01R 43/28* | (2006.01) |

(52) U.S. Cl.

CPC ..... *H01R 13/6581* (2013.01); *H01R 9/0521* (2013.01); *H01R 13/6582* (2013.01); *H01R 24/562* (2013.01); *H01R 43/28* (2013.01); *H01R 2103/00* (2013.01); *H01R 2201/02* (2013.01)

(58) Field of Classification Search

USPC ..... 439/578, 585, 584, 449, 392; 174/74 R, 174/650

See application file for complete search history.

(56) References Cited

U.S. PATENT DOCUMENTS

| | | | | |
|---|---|---|---|---|
| 3,292,136 A * | 12/1966 | Somerset | H01R 9/0521 | 439/584 |
| 4,257,659 A | 3/1981 | Gibbs | | |
| 4,279,457 A | 7/1981 | Nickence | | |
| 4,561,716 A * | 12/1985 | Acke | H01R 24/40 | 439/578 |
| 4,891,015 A * | 1/1990 | Oldfield | H01R 24/542 | 439/172 |
| 5,435,745 A * | 7/1995 | Booth | H01R 9/0521 | 439/583 |
| 5,603,630 A | 2/1997 | Villain | | |
| 5,795,188 A * | 8/1998 | Harwath | 439/583 | |

(Continued)

OTHER PUBLICATIONS

WIPO, International Preliminary Report on Patentability (IPRP) for PCT Application No. PCT/US2014/071368 as mailed Jun. 30, 2016.

(Continued)

*Primary Examiner* — Alexander Gilman
(74) *Attorney, Agent, or Firm* — Barclay Damon, LLP

(57) ABSTRACT

A connector including a resilient Radio Frequency (RF) shield circumscribing a central forward body portion of the connector. The resilient shield conforms to the shape of the recessed port upon axial engagement of the coupling device with the recessed port.

49 Claims, 14 Drawing Sheets

(56) References Cited

U.S. PATENT DOCUMENTS

| | | | | |
|---|---|---|---|---|
| 5,938,465 | A * | 8/1999 | Fox, Sr. | H01R 13/627 439/350 |
| 6,174,206 | B1 * | 1/2001 | Yentile | H01R 24/542 439/578 |
| 6,210,221 | B1 * | 4/2001 | Maury | H01R 9/0521 439/578 |
| 6,672,894 | B2 * | 1/2004 | Sprunger | H01R 9/032 439/449 |
| 7,070,447 | B1 * | 7/2006 | Montena | H01R 24/564 439/578 |
| 7,258,493 | B2 | 8/2007 | Milette | |
| 7,347,727 | B2 * | 3/2008 | Wlos | H01R 13/6277 439/578 |
| 7,357,672 | B2 * | 4/2008 | Montena | H01R 9/0524 174/59 |
| 7,448,896 | B2 | 11/2008 | Malak et al. | |
| 7,645,160 | B2 | 1/2010 | Tabet | |
| 7,674,046 | B2 | 3/2010 | Milette | |
| 7,699,533 | B2 | 4/2010 | Milette | |
| 8,016,614 | B2 | 9/2011 | Xie et al. | |
| 8,038,472 | B2 * | 10/2011 | Montena | H01R 9/0524 439/578 |
| 8,172,617 | B2 | 5/2012 | Peng | |
| 8,303,339 | B2 | 11/2012 | Montena | |
| 8,430,688 | B2 * | 4/2013 | Montena | H01R 24/564 439/578 |
| 8,435,073 | B2 * | 5/2013 | Wild | H01R 24/564 439/578 |
| 8,477,928 | B2 | 7/2013 | Pelletier et al. | |
| 8,827,743 | B1 * | 9/2014 | Maury | H01R 24/40 439/578 |
| 9,172,156 | B2 * | 10/2015 | Nugent | H01R 9/0518 |
| 2005/0117850 | A1 | 6/2005 | Milette | |
| 2007/0298646 | A1 | 12/2007 | Malak et al. | |
| 2008/0013889 | A1 | 1/2008 | Milette | |
| 2008/0013890 | A1 | 1/2008 | Milette | |
| 2008/0132123 | A1 | 6/2008 | Milette et al. | |
| 2008/0194142 | A1 * | 8/2008 | Wlos | 439/584 |
| 2008/0207051 | A1 * | 8/2008 | Montena | 439/578 |
| 2009/0047800 | A1 | 2/2009 | Tabet | |
| 2010/0240228 | A1 * | 9/2010 | Lenhert | 439/32 |
| 2011/0059648 | A1 | 3/2011 | Montena | |
| 2011/0117778 | A1 | 5/2011 | Xie et al. | |
| 2011/0244720 | A1 | 10/2011 | Peng | |
| 2012/0214338 | A1 | 8/2012 | Nugent | |
| 2012/0252265 | A1 | 10/2012 | Wild et al. | |
| 2013/0337683 | A1 * | 12/2013 | Chastain et al. | 439/578 |

OTHER PUBLICATIONS

US Patent and Trademark Office (ISA/US), International Search Report and Written Opinion as completed Mar. 20, 2015 (total 14 pages).

Lair Technologies, "EcE72 Silicon Elastomer", DataSheet [Online], Feb. 10, 2012 [retrieved on Feb. 28, 2015]. [Retrieved from the internet]. http://www.hakuto-products.com/lairdtechnologies/pdf/EMI-DS-ECE72-JPN-Rev3.pdf (total 4 pages).

* cited by examiner

RADIO FREQUENCY (RF) SHIELD FOR MICROCOAXIAL (MCX) CABLE CONNECTORS

CROSS-REFERENCE TO RELATED APPLICATIONS

This application is (a) a non-provisional patent application of, and claims the benefit and priority of, U.S. Provisional Patent Application No. 61/919,149, filed on Dec. 20, 2013, and (b) a non-provisional patent application of U.S. Provisional Patent Application No. 62/040,668, filed Aug. 22, 2014. The entire contents of such applications are hereby incorporated by reference.

BACKGROUND

MicroCoaXial (MCX) interfaces or ports are typically employed in headend cable boxes/devices for splitting/combining Radio Frequency (RF) signals fed from one or more coaxial cables. To maximize system capacity, each MCX device has a plurality of interfaces or ports disposed, in close proximity, i.e., a high density of ports. An example of such MCX interfaces includes the Advanced Technology eXtended (ATX) Maxnet II Platinum Series Ultra Dense Signal Management Systems available from PPC Inc., located in Syracuse, N.Y., USA.

Each MCX port includes a female socket which is recessed relative to a face surface of the cable box/device. To effect an electrical ground, the female socket receives a multi-fingered male plug connected to a cable connector which, in turn, connects to the outer braided conductor of a prepared coaxial cable. To facilitate assembly/disassembly, each female socket is fabricated with a small degree of draft/taper to receive the retention member or male plug of the MCX connector. As a consequence, the manufacture can result in a loose fit between the male plug and female socket, which, in turn, can (i) reduce the reliability of the electrical cable ground, (ii) produce significant RF signal egress/ingress, and (iii) reduce signal performance. With respect to recessed ports employing a plurality of radially biased resilient fingers, egress/ingress of RF energy is exacerbated by the slots between the resilient fingers of the male plug. Finally, the efficacy of the RF signal can be degraded by signal interference with external sources. The high density of recessed ports employed on MCX devices creates additional challenges with respect to signal interference.

Therefore, there is a need to overcome, or otherwise lessen the effects of, the disadvantages and shortcomings described above.

BRIEF DESCRIPTION OF THE DRAWINGS

Features and advantages of the present disclosure are described in, and will be apparent from, the following Brief Description of the Drawings and Detailed Description.

SUMMARY OF THE INVENTION

A shielded RF connector is provided for a recessed interface port comprising an inner conductor engager, an outer conductor engager, a coupling device and a resilient RF shield. The inner and outer conductor engagers are configured to engage the inner and outer conductors, respectively, of the coaxial cable while a coupling device includes a retention member or male plug for engaging the recessed port. The coupling member also includes a forward body which is connected to the retention member at one end and to the outer conductor engager at the other end. The forward body defines an opening or bore configured to center the inner conductor engager, and is operative to mechanically and electrically engage the retention member with an end of the outer conductor engager. The resilient Radio Frequency (RF) shield connects to the forward body and conforms to a surface of the recessed port upon axial engagement of the coupling device with the recessed port.

In one embodiment the resilient RF shield is an elastomer sleeve comprising a nickel/graphite-filled silicone elastomer having a loading density of between approximately 2.0 g/cm$^3$ to approximately 2.4 g/cm$^3$. Furthermore, the elastomer sleeve comprises a resistivity of approximately 0.10 ohm-cm to approximately 0.06 ohm-cm.

In another embodiment, the resilient RF shield comprises a conductive cone having a ring portion and a cone portion wherein the ring portion engages a first portion of the outer conductor engager and the conductive cone portion diverges outwardly in a radial direction from the axis of the outer conductor engager. The conductive cone portion defines a cone angle of between about 15 degrees to about 25 degrees relative to the axis of the outer conductor engager.

In another embodiment, the resilient RF shield comprises a plurality of spring-biased nesting segments. The segments variably overlap depending upon the angular position of each segment relative to the axis of the port. The segments are fully nested when the cone angle is at a minimum and fully spread when the cone angle is at a maximum. Even when the cone angle is at a maximum, the segments remain at least partially overlapped.

DETAILED DESCRIPTION

1. Overview 1.1 Networks and Interfaces

Figure 1:
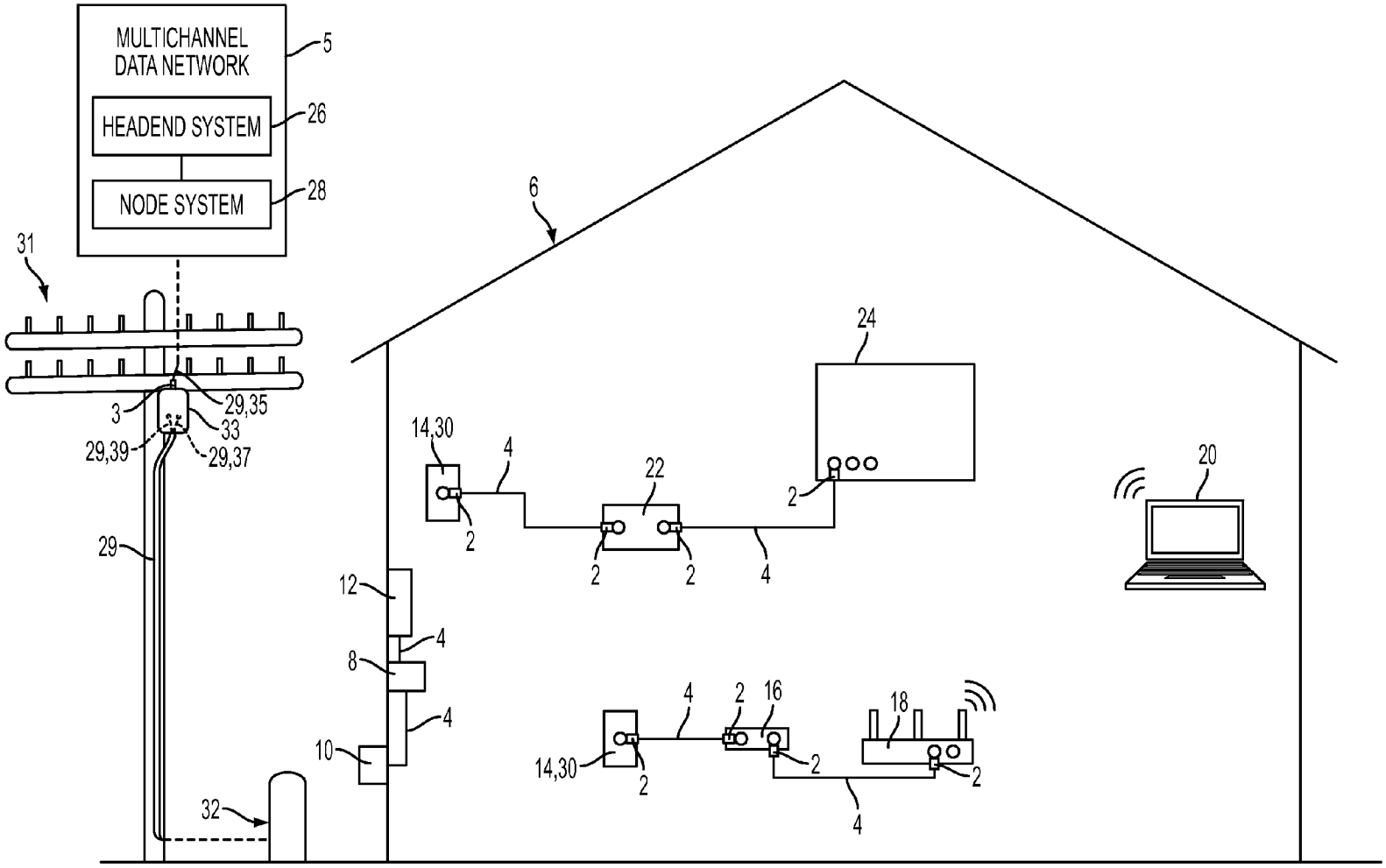
FIG. 1 is a diagram illustrating an environment coupled to a multichannel data network.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In one distribution method, the data service provider operates a headend facility or headend system 26 coupled to a plurality of optical node facilities or node systems, such as node system 28. The data service provider operates the node systems as well as the headend system 26. The headend system 26 multiplexes the TV channels, producing light beam pulses which travel through optical fiber trunklines. The optical fiber trunklines extend to optical node facilities in local communities, such as node system 28. The node system 28 translates the light pulse signals to RF electrical signals.

In one embodiment, a drop line coaxial cable or weather-protected or weatherized coaxial cable 29 is connected to the headend facility 26 or node facility 28 of the service provider. In the example shown, the weatherized coaxial cable 29 is routed to a standing structure, such as utility pole 31. A splitter or entry junction device 33 is mounted to, or hung from, the utility pole 31. In the illustrated example, the entry junction device 33 includes an input data port or input tap for receiving a hardline connector or pin-type connector 3. The entry junction box device 33 also includes a plurality of output data ports within its weatherized housing. It should be appreciated that such a junction device can include any suitable number of input data ports and output data ports.

The end of the weatherized coaxial cable 35 is attached to a hardline connector or pin-type connector 3, which has a protruding pin insertable into a female interface data port of the junction device 33. The ends of the weatherized coaxial cables 37 and 39 are each attached to one of the connectors 2 described below. In this way, the connectors 2 and 3 electrically couple the cables 35, 37 and 39 to the junction device 33. In one embodiment, the pin-type connector 3 has a male shape which is insertable into the applicable female input tap or female input data port of the junction device 33. The two female output ports of the junction device 33 are female-shaped in that they define a central hole configured to receive, and connect to, the inner conductors of the connectors 2.

In one embodiment, each input tap or input data port of the entry junction device 33 has an internally threaded wall configured to be threadably engaged with one of the pin-type connectors 3. The network 5 is operable to distribute signals through the weatherized coaxial cable 35 to the junction device 33, and then through the pin-type connector 3. The junction device 33 splits the signals to the pin-type connectors 2, weatherized by an entry box enclosure, to transmit the signals through the cables 37 and 39, down to the distribution box 32 described below.

In another distribution method, the data service provider operates a series of satellites. The service provider installs an outdoor antenna or satellite dish at the environment 6. The data service provider connects a coaxial cable to the satellite dish. The coaxial cable distributes the RF signals or channels of data into the environment 6.

In one embodiment, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol (VoIP) phone service, Internet Protocol TV ("IPTV") data streams, multimedia content, audio data, music, radio and other types of data.

In one embodiment, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range 1125 MHz to 1675 MHz. MoCA compatible devices can form a private network inside the environment 6.

In one embodiment, the MoCA network includes a plurality of network-connected devices, including, but not limited to: (a) passive devices, such as the PoE filter 8, internal filters, diplexers, traps, line conditioners and signal splitters; and (b) active devices, such as amplifiers. The PoE filter 8 provides security against the unauthorized leakage of a user's signal or network service to an unauthorized party or non-serviced environment. Other devices, such as line conditioners, are operable to adjust the incoming signals for better quality of service. For example, if the signal levels sent to the set-top box 22 do not meet designated flatness requirements, a line conditioner can adjust the signal level to meet such requirement.

In one embodiment, the modem 16 includes a monitoring module. The monitoring module continuously or periodically monitors the signals within the MoCA network. Based on this monitoring, the modem 16 can report data or information back to the headend system 26. Depending upon the embodiment, the reported information can relate to network problems, device problems, service usage or other events.

At different points in the network 5, cables 4 and 29 can be located indoors, outdoors, underground, within conduits, above ground mounted to poles, on the sides of buildings and within enclosures of various types and configurations. Cables 29 and 4 can also be mounted to, or installed within, mobile environments, such as land, air and sea vehicles.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
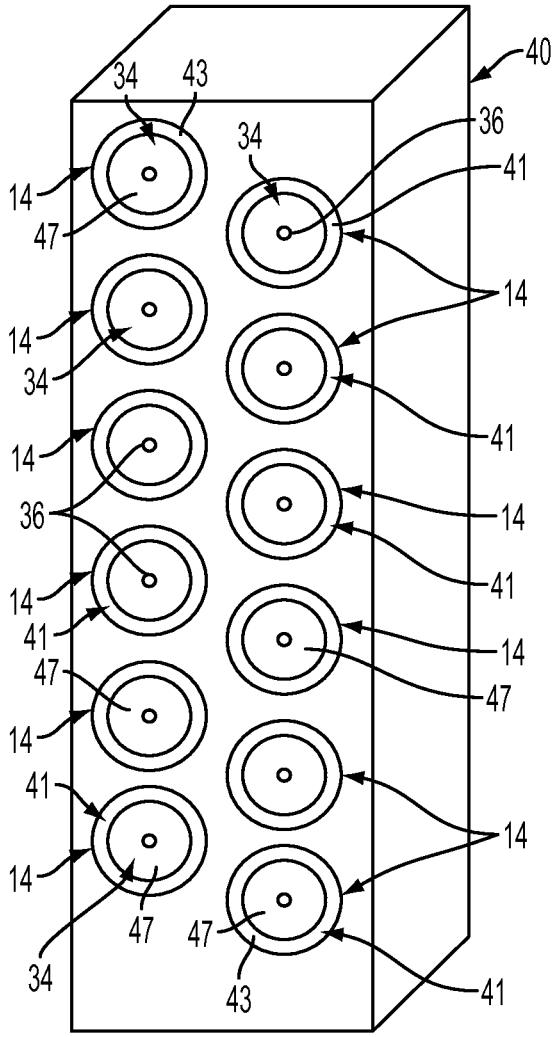
FIG. 2 is an isometric view of one embodiment of an MCX device having a plurality of interface ports which are configured to be operatively coupled to the multichannel data network.
Figure 4:
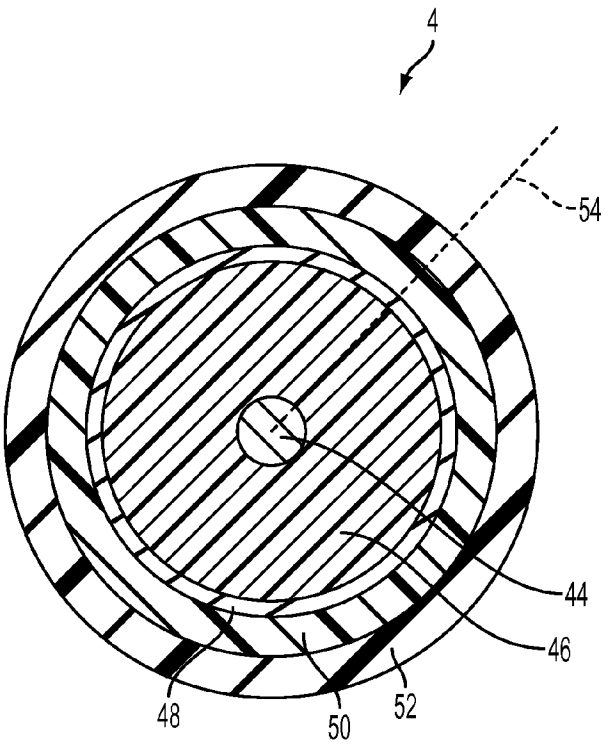
FIG. 4 is a cross-sectional view of the cable of FIG. 3, taken substantially along line 4-4.

In one embodiment, each of the female interface ports 14 includes a receptacle 34 illustrated in FIG. 2. Each receptacle 34 has: (a) an inner, cylindrical wall 36 defining a central hole configured to receive an electrical contact, wire, pin, conductor (not shown) positioned within the central *hole; (b) a conical conductive region 41 having a conductive contact surface 43; and (c) a dielectric or insulation material 47

In one embodiment receptacle or socket 14 is shaped and sized to be compatible with a standard MCX connector. It should be understood that, depending upon the embodiment, the receptacle 34 can have a smooth outer surface. Further, the receptacle 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, an installer couples a cable 4 to an interface port 14 by screwing or pushing the connector 2 onto the interface port 14. Once installed, the connector 2 establishes an electrical connection between the cable 4 and the electrical contacts of the interface port 34.

After installation, the connectors 2 often undergo various forces. For example, there may be tension in the cable 4 as it stretches from one device 40 to another device 40 imposing a steady, tensile load on the connector 2. A user might occasionally move, pull or push on a cable 4 from time to time, causing forces on the connector 2. Alternatively, a user might swivel or shift the position of a TV 24, causing bending loads on the connector 2. As described below, the connector 2 is structured to maintain a suitable level of electrical connectivity despite such forces.

1.2 Cable

Referring to FIGS. 3-6, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in one embodiment, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

Figure 3:
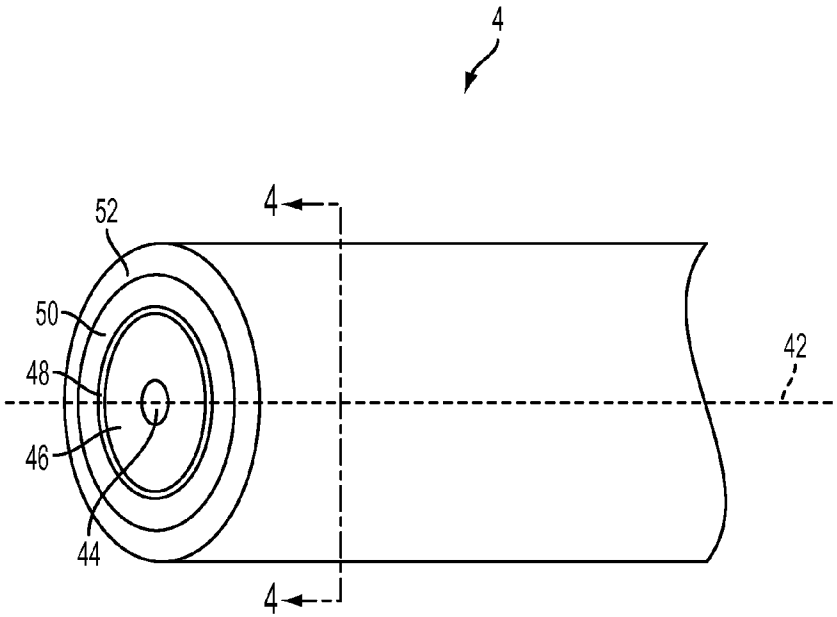
FIG. 3 is an isometric view of one embodiment of a coaxial cable which is configured to be operatively coupled to the multichannel data network.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, as described below, the connector 2 electrically grounds the outer conductor 50 of the coaxial cable 4. When the inner conductor 44 and external electronic devices generate magnetic fields, the grounded outer conductor 50 sends the excess charges to ground. In this way, the outer conductor 50 cancels all, substantially all or a suitable amount of the potentially interfering magnetic fields. Therefore, there is less, or an insignificant, disruption of the data signals running through inner conductor 44. Also, there is less, or an insignificant, disruption of the operation of external electronic devices near the cable 4.

In one such embodiment, the cable 4 has one or more electrical grounding paths. One grounding path extends from the outer conductor 50 to the cable connector's conductive post, and then from the connector's conductive post to the interface port 14. Depending upon the embodiment, an additional or alternative grounding path can extend from the outer conductor 50 to the cable connector's conductive body, then from the connector's conductive body to the connector's conductive nut or coupler, and then from the connector's conductive coupler to the interface port 14.

The conductive foil layer 48, in one embodiment, is an additional, tubular conductor which provides additional shielding of the magnetic fields. In one embodiment, the foil layer 48 includes a flexible foil tape or laminate adhered to the insulator 46, assuming the tubular shape of the insulator 46. The combination of the foil layer 48 and the outer conductor 50 can suitably block undesirable radiation or signal noise from leaving the cable 4. Such combination can also suitably block undesirable radiation or signal noise from entering the cable 4. This can result in an additional decrease in disruption of data communications through the cable 4 as well as an additional decrease in interference with external devices, such as nearby cables and components of other operating electronic devices.

In one embodiment, the jacket 52 has a protective characteristic, guarding the cable's internal components from damage. The jacket 52 also has an electrical insulation characteristic. In one embodiment, the jacket 52 is compressible along the radial line 54 and is flexible along the longitudinal axis 42. The jacket 52 is constructed of a suitable, flexible material such as polyvinyl chloride (PVC) or rubber. In one embodiment, the jacket 52 has a lead-free formulation including black-colored PVC and a sunlight resistant additive or sunlight resistant chemical structure.

Figure 5:
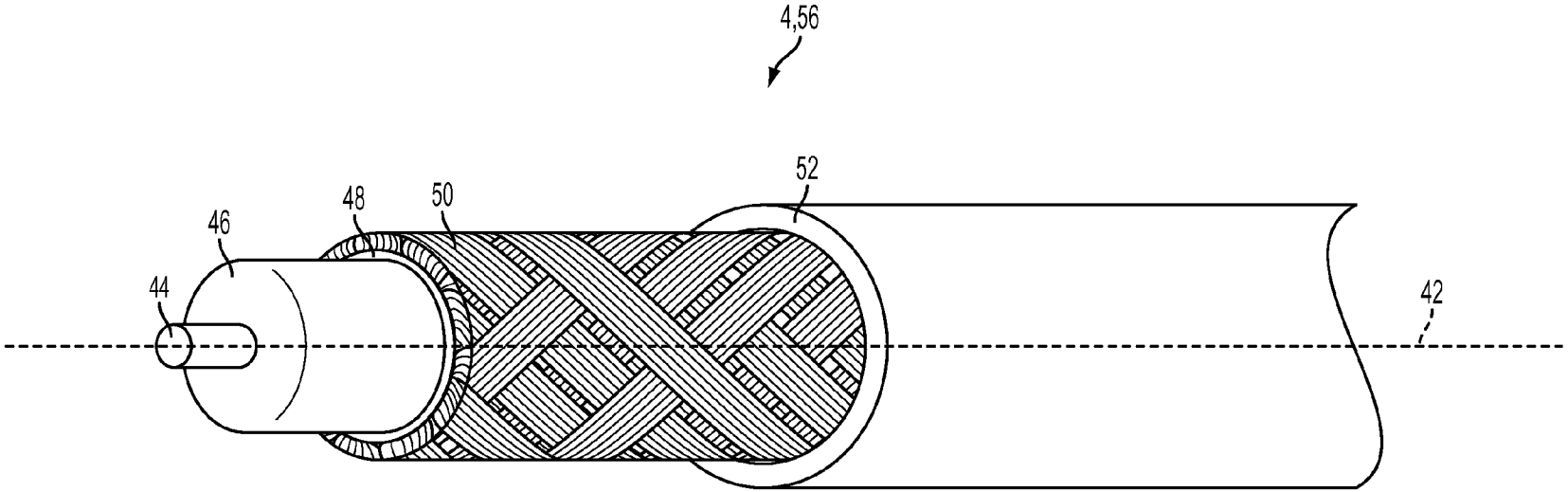
FIG. 5 is an isometric view of one embodiment of a coaxial cable which is configured to be operatively coupled to the multichannel data network, illustrating a three-stepped prepared end of the coaxial cable.
Figure 6:
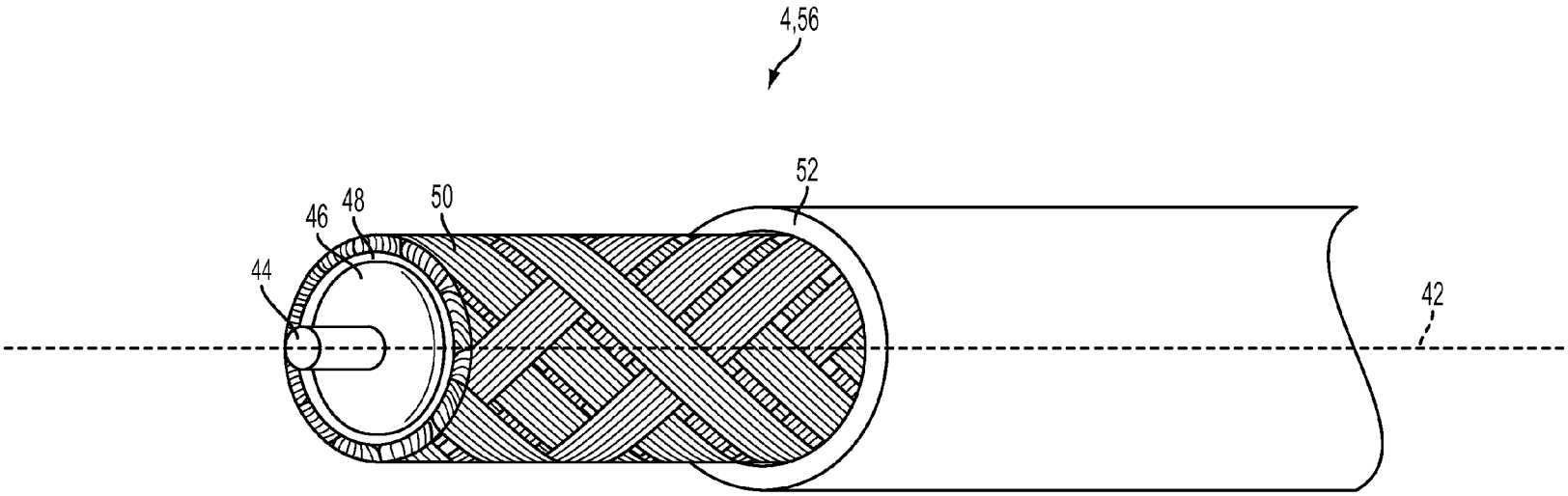
FIG. 6 is an isometric view of one embodiment of a coaxial cable which is configured to be operatively coupled to the multichannel data network, illustrating a two stepped prepared end of the coaxial cable.

Referring to FIGS. 5-6, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a three step-shaped configuration. In the example shown in FIG. 6, the prepared end 58 has a two step-shaped configuration. The preparer can use cable preparation pliers or a cable stripping tool to remove such portions of the cable 4. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 7:
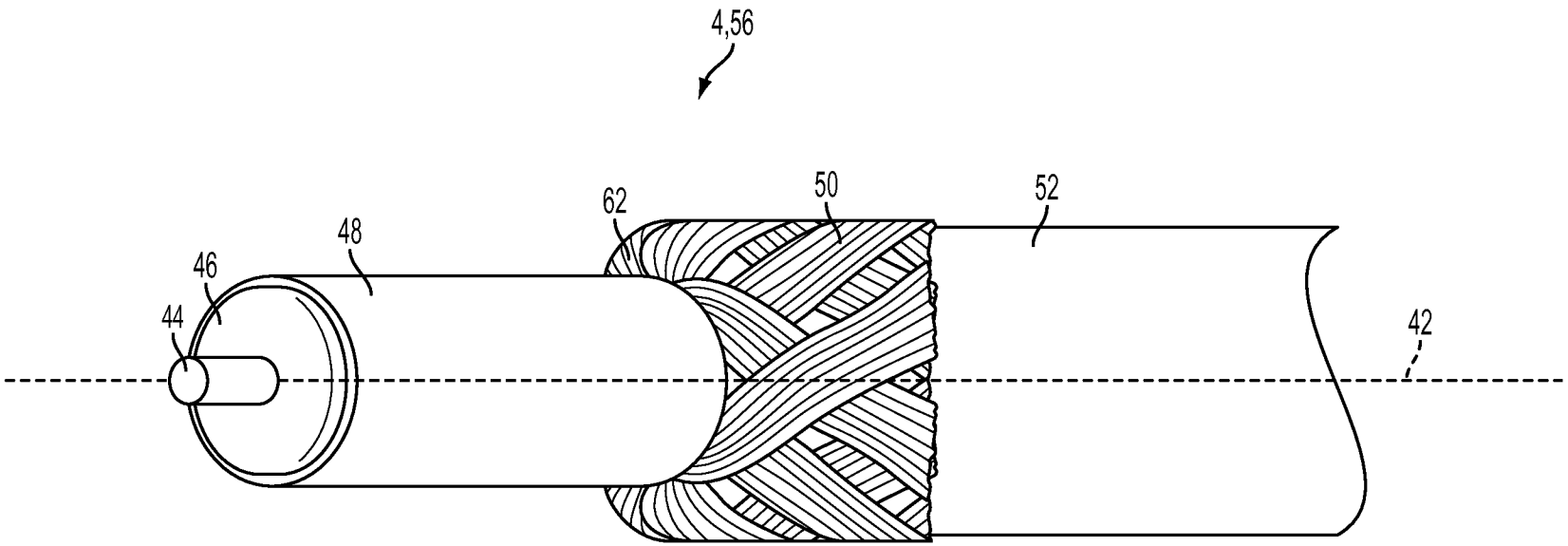
FIG. 7 is an isometric view of one embodiment of a coaxial cable which is configured to be operatively coupled to the multichannel data network, illustrating the folded-back, braided outer conductor of a prepared end of the coaxial cable.

In one embodiment illustrated in FIG. 7, the installer or preparer performs a folding process to prepare the cable 4 for connection to connector 2. In the example illustrated, the preparer folds the braided outer conductor 50 backward onto the jacket 52. As a result, the folded section 60 is oriented inside out. The bend or fold 62 is adjacent to the foil layer 48 as shown. Certain embodiments of the connector 2 include a tubular post. In such embodiments, this folding process can facilitate the insertion of such post in between the braided outer conductor 50 and the foil layer 4

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 8:
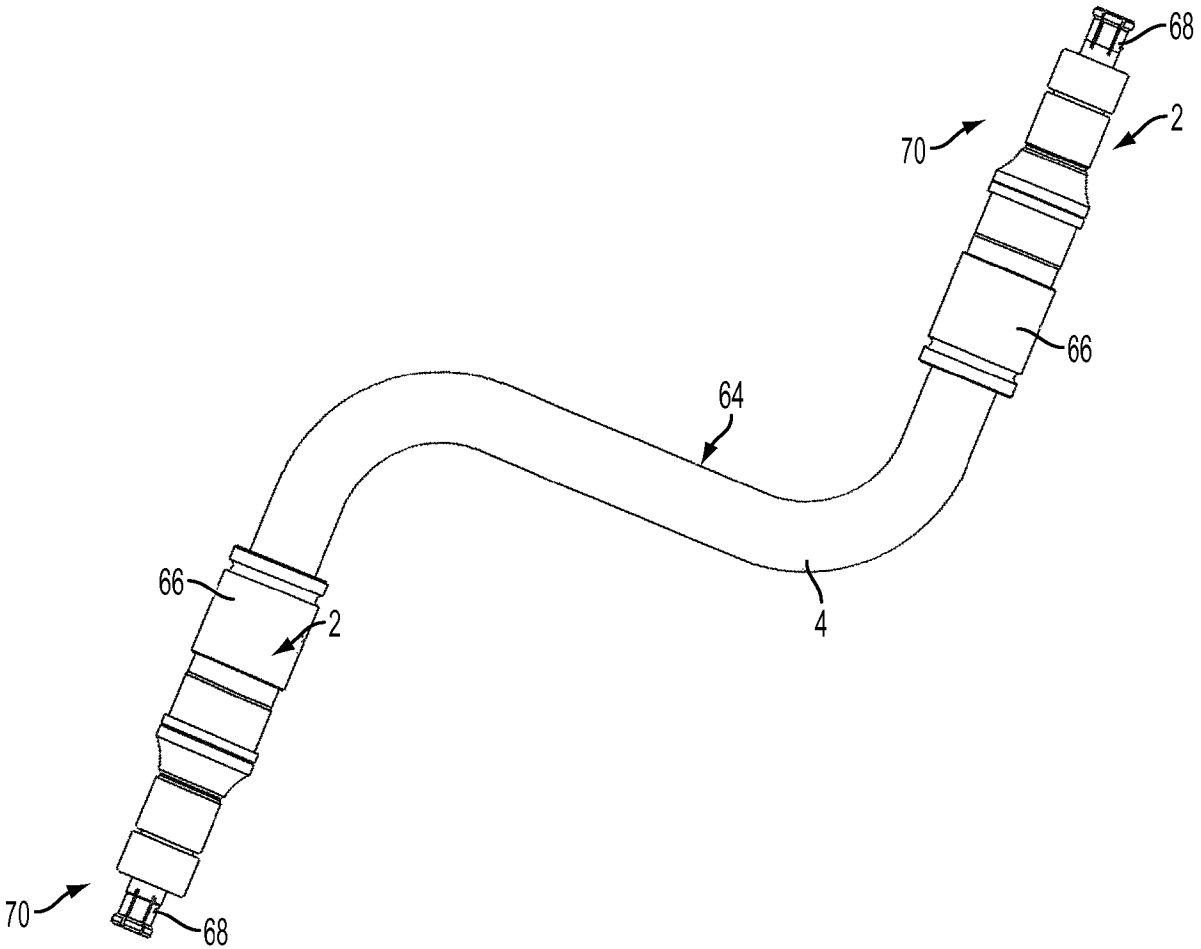
FIG. 8 is a top view of one embodiment of a coaxial cable jumper or cable assembly which is configured to be operatively coupled to the multichannel data network.

In one embodiment illustrated in FIG. 8, a cable jumper or cable assembly 64 includes a combination of the connector 2 and the cable 4 attached to the connector 2. In this embodiment, the connector 2 includes: (a) a connector body or connector housing 66; and (b) a male plug 68, which is snap-fit into the receptacle 34 of an MCX device 40. The cable assembly 64 has, in one embodiment, connectors 2 on both of its ends 70. Preassembled cable jumpers or cable assemblies 64 can facilitate the installation of cables 4 for various purposes.

In one embodiment the weatherized coaxial cable 29, illustrated in FIG. 1, has the same structure, configuration and components as coaxial cable 4 except that the weatherized coaxial cable 29 includes additional weather protective and durability enhancement characteristics. These characteristics enable the weatherized coaxial cable 29 to withstand greater forces and degradation factors caused by outdoor exposure to weather.

2.0 Coaxial Cable Connector Having an RF Shielding Member

Figure 9:
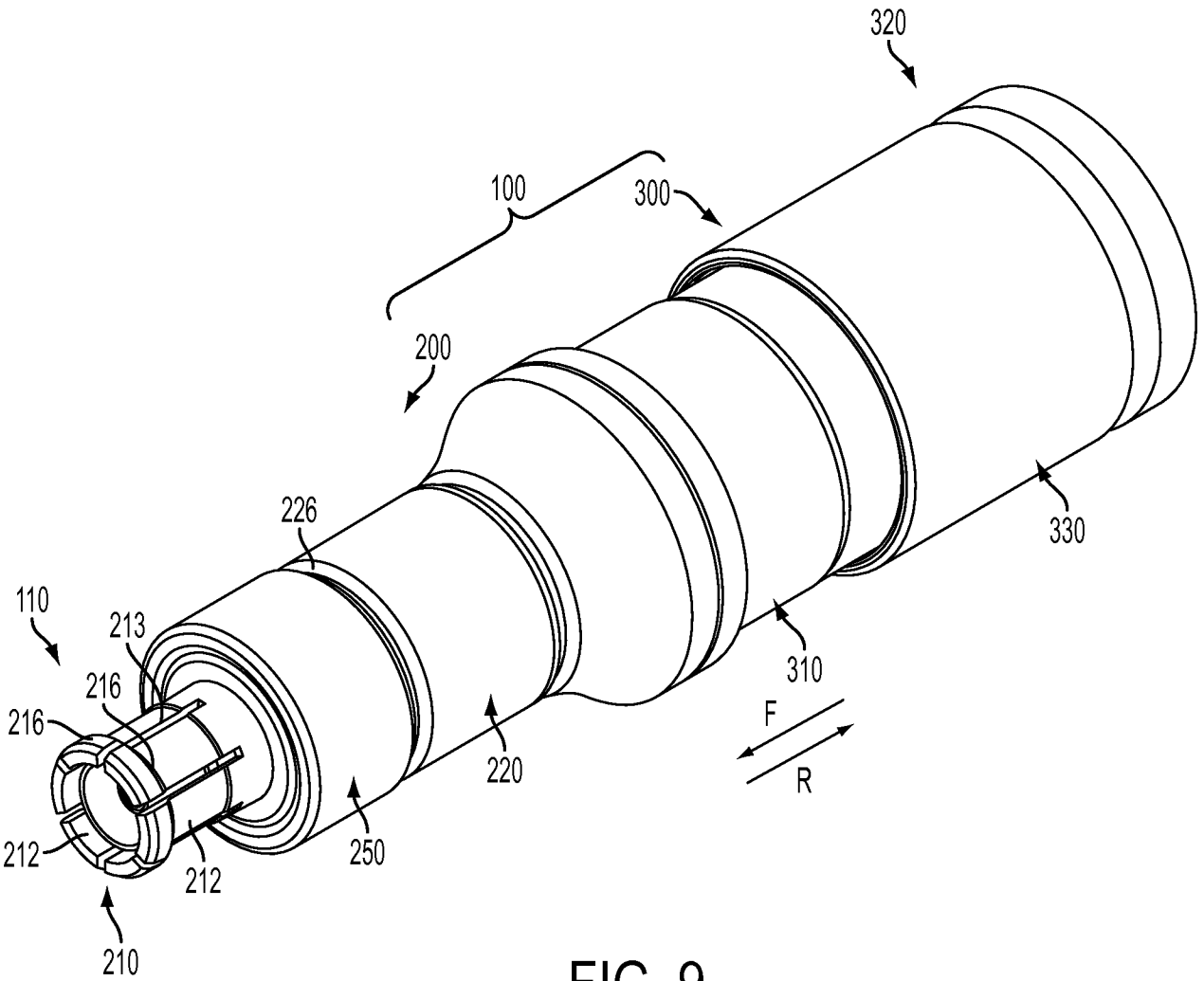
FIG. 9 is an isometric view of a shielded MCX connector having an RF shield according to one embodiment of the present disclosure.

FIG. 9 depicts a reliable, low cost, shielded MCX connector 100 for an MCX interface or port. The shield mitigates the ingress/egress of RF energy entering/leaving the MCX interface port, and also provides a secondary, or alternative, ground path for the MCX connector. That is, in addition to the grounding connection between the male plug and the female socket, i.e., through the conventional coupling for connecting the plug to the socket, the shield augments the ground path by providing a secondary path to an inner or outer surface of the recessed port 120.

For the purposes of defining spatial relationships, and establishing a frame of reference, it will be useful to define the geometry and structure of the connector 100 in terms of the MCX interface port/device, i.e., the connecting component. More specifically, and referring to FIGS. 9 and 11, the "forward" direction is shown by a forwardly pointing arrow F toward the MCX interface port 120. The "aft" direction is given by a rearwardly pointing arrow R.

The cable connector 100 according to an embodiment of the present disclosure includes an inner conductor engager 230 configured to receive the inner conductor 44 of a coaxial cable 4, and an outer conductor engager 310 configured to receive the outer conductor 50 of the coaxial cable 4. In one embodiment, the cable connector 100 employs a coupling device 210, 220 including a male plug 210 and forward body 220 supporting the male plug 210. The coupling device 210, 220, discussed in greater detail below, further employs a plurality of spring-biased retention members operative to capture the inner conductor engager 230 of the connector 100 upon axial engagement of the coupling device 210, 220 within the socket of the recessed port 120.

Figure 10:
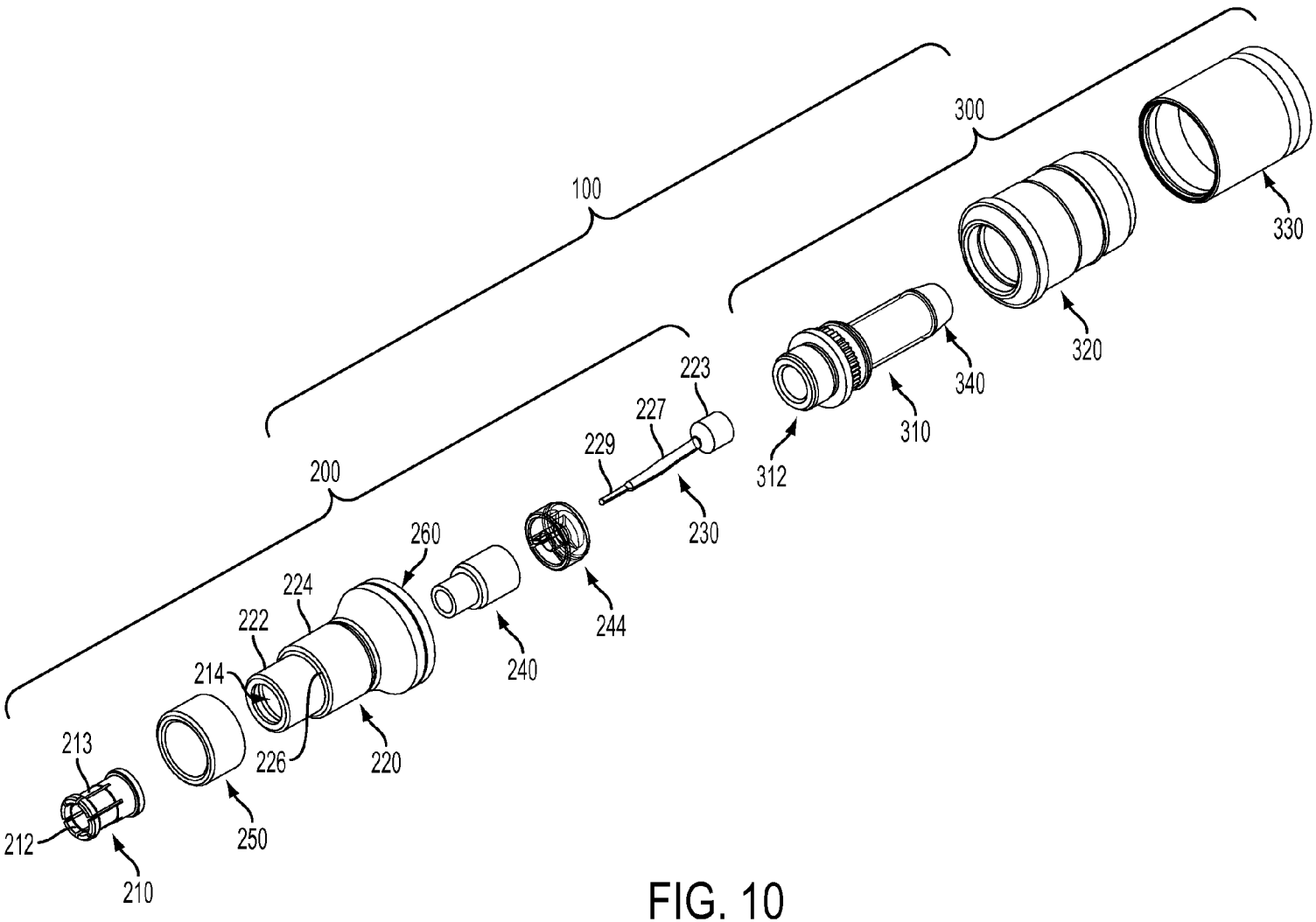
FIG. 10 is a exploded isometric view of the shielded MCX connector shown in FIG. 9.

In FIGS. 9-12, an MCX cable connector 100 according to an embodiment of the present disclosure includes a first end portion or forward portion 200 and a second end portion or aft portion 300 (see FIG. 10). The forward portion 200 electrically and mechanically connects a forward end 110 (FIG. 9) of the cable connector 100 to a female socket or port 120 (FIG. 11) of an MCX device 150. Furthermore, the forward portion 200 electrically grounds and prevents the ingress/egress of electrical energy to/from the recessed port 120. That is, the shielded MCX connector 100 mitigates cross-talk between adjacent, or closely-spaced, interface ports. FIG. 2 provides an illustration of such closely-spaced ports 14 in the aft panel of a cable device 40.

Structurally, the first or forward portion 200 of the connector 100 includes: (i) a coupling device 210, 220, (ii) an inner conductor receptacle or engager 230 centered within a portion 220 of the coupling device 210, 220 and configured to receive the inner conductor 44 of the coaxial cable 4, and (iii) first and second spool-shaped insulators 240, 244 defining first and second aligned apertures 234, 238, respectively, for centering the inner conductor engager 230 within a bore or opening 214 of the coupling device 210, 220.

The coupling member includes a retention member or male plug 210 and a forward body 220 coupled to, or integrated with, an aft end of the retention member 210. The retention member 210 includes a plurality of spring biased retention fingers 212 configured to seat within, and engage, the recessed port 120. The retention fingers 212 are separated by a plurality of elongate slots 213 (see FIGS. 9 and 12) and are biased in a radially outward direction to engage an annular groove 144 of the recessed port 120. Each finger 212 includes a shoulder 216 configured to engage the outwardly facing annular groove 144 of the recessed port 120. It should be appreciated that while each of the spring-biased fingers 212 provides axial retention, each of the fingers 212 is conductive to provide an electrical path to ground the outer conductor 50 of the coaxial cable 4

The forward body 220 connects to, or is integrated with, the retention fingers 212 of the coupling device 210, 220, and is operative to: (i) center the inner conductor engager 230, and (ii) mechanically and electrically connect the retention fingers 212 to a forward end 260 of the outer conductor engager 310. The forward body 220, therefore, functions to provide the primary structural and electrical load path between the coaxial cable 4, i.e., the inner and outer conductors 44, 50 thereof, and the recessed port 120.

Furthermore, the forward body 220 produces a circumferential step 226 by an abrupt change in diameter from a first or forward region 222 to a second or aft region 224. More specifically, the first region 222 defines a first diameter dimension which is less than the second diameter dimension of the second region 224. Moreover, the first region 222 has a prescribed length L (see FIGS. 11 and 12) measured from a forward end thereof to the step 226. Finally, the first region 222 may also include one or more directional ridges 221*a*, 221*b* (FIG. 12) disposed about the outer cylindrical surface or circumference of the forward body 220. The import of the geometry and dimensions of the forward body 220 will become apparent in subsequent paragraphs when discussing the operation of the connector 100.

The inner conductor engager 230 includes an aft guide 223 defining a funnel-shaped throat 225 (FIG. 11) to guide the inner conductor 44 of the coaxial cable 4 into a tubular-shaped pin extender 227 of the engager 230. The pin extender 227 includes a tubular-shaped aperture 228 for receiving the inner conductor 44 and a forward pin 229 disposed at the forward end thereof for receipt within a pin receptacle 154 of the interface port 120. The first spool-shaped insulator 240 centers the pin extender 228 within the forward body 220 of the connector 100 while the second spool-shaped insulator 244 centers both the pin extender 228 and aft guide 225 within the forward body 220.

The second or aft portion 300 of the connector 100 electrically and mechanically engages a prepared end 130 of the coaxial cable 4. More specifically, the aft portion 300 electrically couples the prepared end 130 of the cable connector 100 to the inner and outer conductors 44, 50 of the coaxial cable 4. Furthermore, the aft portion 300 effects a frictional and mechanical interlock between the connector 100 and the cable 4. The mechanical interlock is augmented by a barbed sleeve 330 of the outer conductor engager Structurally, the aft portion 300 includes: (i) an outer conductor engager 310 having an opening 314 coaxially aligned with the aligned apertures 234, 238 of the forward body 220, (ii) an aft body 320 disposed over and configured to form an annular cavity 324 (see FIG. 11) with the outer conductor engager 310 (the annular cavity 324 receiving a braided outer conductor 44 and compliant outer jacket of the coaxial cable), and (iii) a compression cap 330 operative to radially displace the aft body 320 inwardly to compress the outer conductor 50 and jacket 52 of the cable 4 against the outer conductor engager 310.

The outer conductor engager 310 also includes a forward sleeve 312 which is connected to an aft end 260 of the forward body 220. More specifically, the aft end 260 may be press fit, threaded, welded, or soldered to the forward sleeve 312 of the outer conductor engager 310. Notwithstanding the manner by which the outer conductor engager 310 integrates with the forward body 220, it should be appreciated that a structural and electrical connection or path is created from the outer conductor engager 310 to the recessed port 120, i.e., from the retention member or male plug 210 to the outer conductor 310 of the coaxial cable 4, through the forward body 220.

To obviate redundancy of description, the aft portion 300 secures the connector 100 to the coaxial cable 4 in essentially the same manner, i.e., employing the same structure and materials, as those previously discussed in connection with FIGS. 3-6 above.

A resilient Radio Frequency (RF) shielding member or shield 250 circumscribes the forward body 220 and conforms to the internal shape of the recessed port 120 upon axial engagement of the connector 100 with the recessed port. The RF shielding member 250 is disposed over the forward body 220 and configured to form an electrical connection/shield with a conductive inner surface 124 of the female socket or port 120 of the MCX device 150. This device 150 may be similar, i.e., have a similar port configuration, to the device 40 discussed earlier in connection with FIG. 2.

The shielding member 250 may comprise a compliant, electrically conductive sleeve 250 disposed over the first region 222 of the forward body 220. In the described embodiment, the sleeve 250 is shown as a continuous structure, however, it should be appreciated that the sleeve 250 may be split, or segmented, to facilitate assembly/disassembly. Furthermore, while shielding member 250 provides three-hundred and sixty degrees (360°) of coverage, it will be appreciated that, depending upon the underlying structure, the degree of coverage may be less than the a full revolution. Hence, a small circumferential gap, e.g., five or ten degrees (5° or 10°), may be allowable, while still functioning as intended.

The resilient sleeve 250 may be comprised of a nickel/graphite-filled silicone elastomer having a loading density of between approximately 2.0 g/cm$^3$ to approximately 2.4 g/cm$^3$. Additionally, the electrical resistivity of the resilient sleeve 250 may be approximately 0.10 ohm-cm to approximately 0.06 ohm-cm. Finally, the resilient sleeve 250 has a prescribed length S which is less than the prescribed length L of the first region 222 of the forward body 220. In the illustrated embodiment, the difference $\Delta L$ is shown as the differential between the prescribed lengths S and L of the sleeve 250 and first region 222, respectively. As such, the sleeve 250 may travel a prescribed length S, i.e., displaced a distance $\Delta L$, to effect radial displacement as the resilient sleeve 250 contacts the circumferential step 226. The import of these features and dimensions will also become apparent in the subsequent discussion concerning the operation of the resilient sleeve 250.

Each female port 120 of an MCX device 150 includes a recess 140 for receiving the coupling device 210 of the connector 100. The recess 140 defines: (i) a lower receptacle 142, (ii) an outwardly facing annular groove or lip 144 disposed at the base of the lower receptacle 142, (iii) an upper receptacle 146, and (iv) a step or shoulder 148 disposed between the lower and upper receptacles 142, 146 effecting a change in diameter or size from the lower to the upper receptacles 142, 146. Furthermore, the step or shoulder 148 is a predetermined length or distance from the lip 144. The upper receptacle 146 may be frustum-shaped, i.e., have a slightly diverging taper defining an angle θ of approximately one (1) to two (2) degrees relative to the elongate axis 100A of the connector 100. The angle θ of the diverging taper has been exaggerated for illustration purposes. Additionally, the port 120 includes a conductive pin receptacle 154 for receiving a forward pin 229 of the inner conductor receptacle 230.

Assembly & Operation

Figure 11:
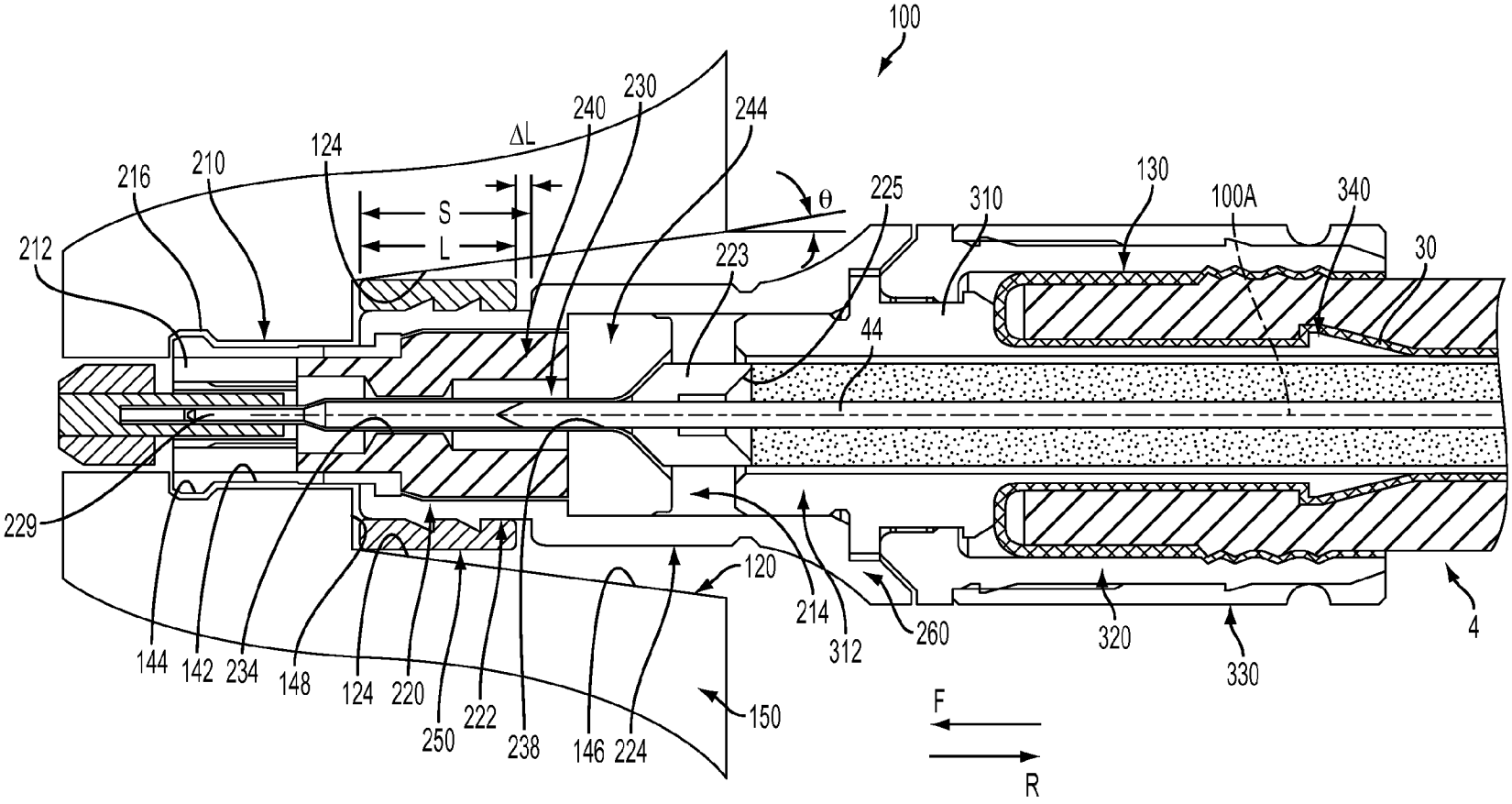
FIG. 11 is a schematic sectional view of the shielded MCX connector including a retention member disposed in combination with a tapered female socket of an MCX interface port, and a compliant, electrically-conductive, RF shield disposed over a forward body of the connector.
Figure 12:
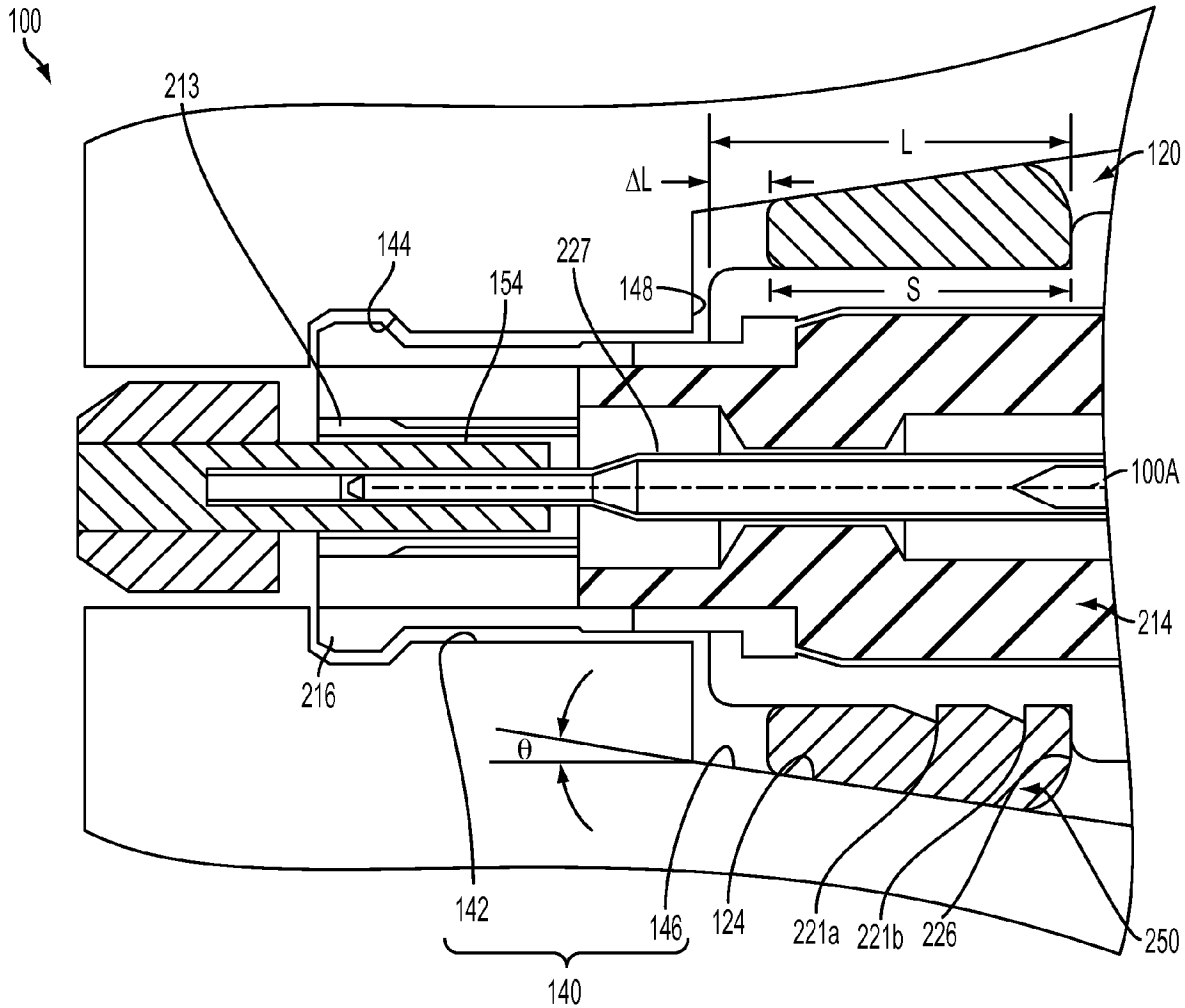
FIG. 12 is an enlarged view of the compliant, electrically-conductive shield which is deformed upon axial engagement with the recessed port.

During assembly, and referring to FIGS. 11 and 12, the port 120 receives the coupling device 210 such that the spring fingers 212 engage the annular groove 144 of the lower recess 140. To effect a secure electrical and mechanical connection, the connector 100 is urged into the recess 140 such that the resilient sleeve 250 deforms when engaging the frustum shaped, tapered surface 148 of the upper receptacle 146. The elastic properties of the resilient sleeve 250 produce an axial bias which maintains electrical contact between the fingers 212 and the annular groove 144. Of course, the elastic properties come into play only after the shielded RF connecter is assembled. That is, while the sleeve is deformed, it is also providing the function of biasing the retention members 210 and the forward body 220 to promote electrical contact when in an assembled state. As such, the resilient sleeve 250 may eradicate, or offset gaps, due to flaws in a manufacturing step or process.

In one embodiment, the resilient sleeve 250 slides over the directional ridges 221*a*, 221*b* as the connector 100 is inserted into the port 120. The directional ridges 221*a*, 221*b* facilitate axial movement of the sleeve 250 in one direction, i.e., in a rearward direction R, but retard its motion in the other direction, i.e., in a forward direction F, to maintain its position during operation. In addition to maintaining position, the directional ridges 221*a*, 221*b* serve to concentrate the conductive material, i.e., the particulate matter, in the sleeve 250 such that a broader band of RF energy may be blocked or shielded. That is, by concentrating or diminishing the size of the opening between conductive fibers or particulate matter within the loaded elastomer sleever 250, bands of RF energy having a higher frequency may now be blocked from passage.

Additionally, the shielding member 250 of the present disclosure blocks or attenuates RF energy within the recess 140 of the MCX device 150 by "capping-off" the recess 140. Whereas the prior art attempts to close-off an upper region of the resilient fingers, the prior art does not provide three-hundred and sixty degrees (360°) of protection around the port 120. The flexibility of the conductive resilient sleeve 250, along with its ability to conform to the shape of the recess 140, fills in and closes gaps and/or deviations which may exist between an edge of the receptacle 146 and the sleeve 250.

Furthermore, the shielding member 250 prevents the ingress of RF energy from adjacent connectors 100 which may be in close proximity. Finally, the properties of the shielding member 250 serve to eradicate RF leakage due to flaws or deviations in a manufacturing process or method. While only one MCX interface port 150 has been depicted, it should be appreciated that the MCX connector 100 has greatest application when applied to multiple sockets/ports disposed in close proximity. More specifically, the shielding member 250 mitigates interference or cross-talk between connectors.

Figure 13:
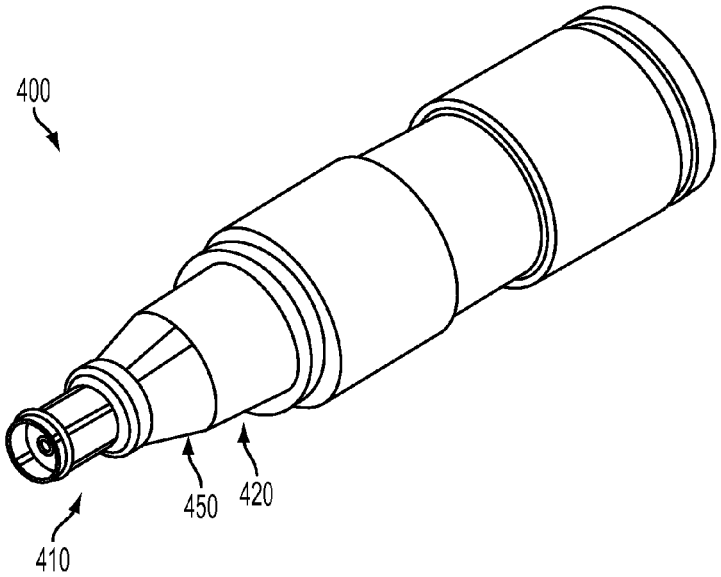
FIG. 13 is an isometric view of another embodiment of the shielded MCX connector including a compliant conical shield disposed about a forward portion of the MCX connector.
Figure 14:
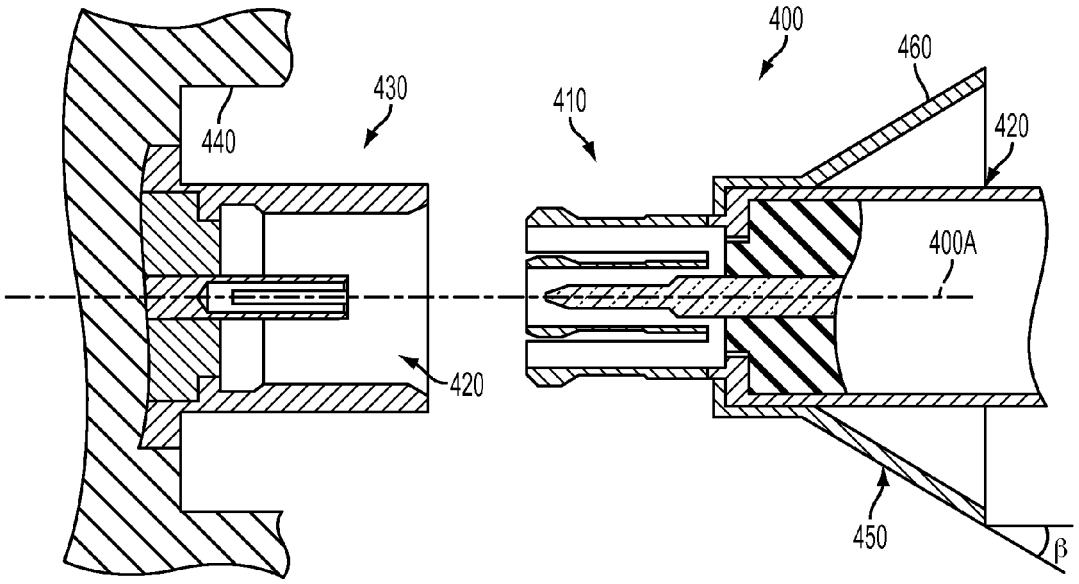
FIG. 14 depicts a broken away, sectional view of the shielded MCX connector shown in FIG. 13 wherein the compliant cone is decoupled from a recess of an MCX interface port.
Figure 15:
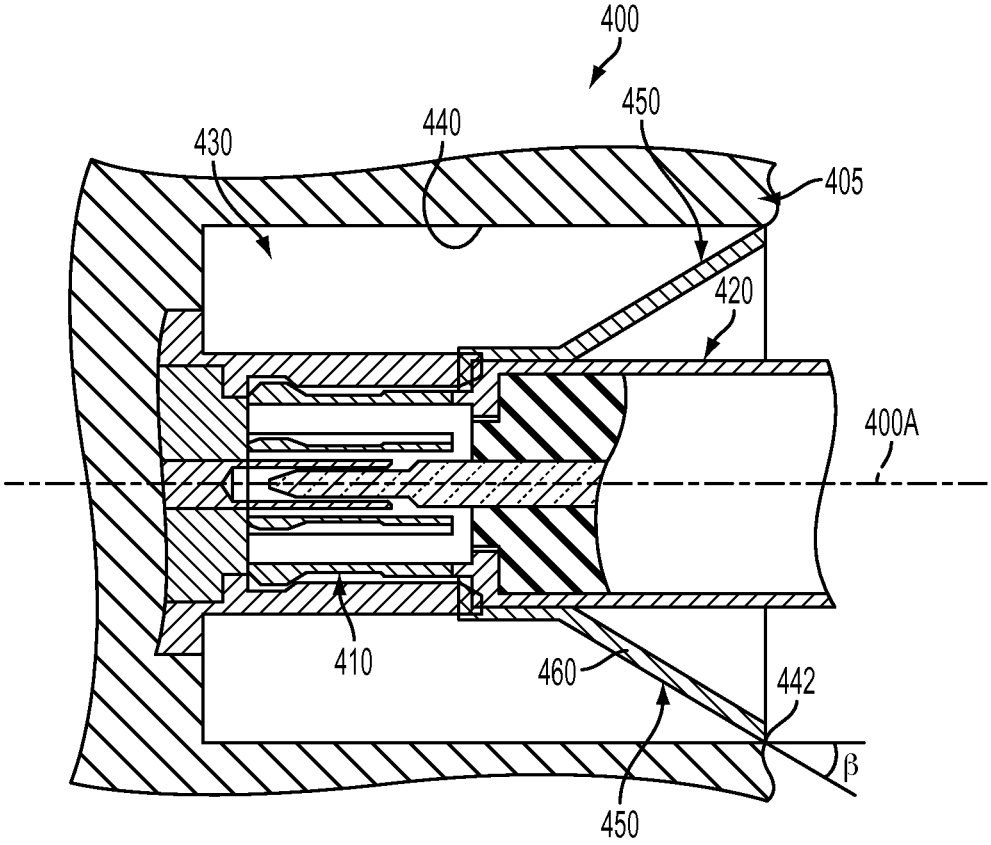
FIG. 15 depicts a broken away, sectional view of the shielded MCX connector shown in FIG. 13 wherein the compliant conical shield is coupled with the recess of the MCX interface port.

FIGS. 13-15 depict yet another embodiments of the MCX cable connector 400 wherein a recessed port 405 receives a coupling member including a retention member or male plug 410 and a forward body 420. Therein, the recessed port 405 defines a cavity 430 having an internal sidewall 440 and/or a circular cavity edge 442.

In this embodiment, a resilient Radio Frequency (RF) shield 450 circumscribes the forward body 420 and conforms to the shape of the recessed port 420, or part thereof, upon axial engagement of the coupling member with the recessed port 420. In this embodiment, the shield engages the circular edge 442 of the recessed port 405. The resilient shield 450 may include a conductive cone 460 defining an outwardly diverging angle β relative to the central axis 400A of the recessed port 405.

In the described embodiment, the cone defines an angle β of between about fifteen degrees (15°) to about twenty-five degrees (25°) relative to the axis of the recessed port 420. While angles between five degrees (5°) and forty-five degrees (45°) may be employed, shallow angles provide additional flexibility, i.e., allow the cone to conform without bending or buckling. In the illustrated embodiment, the cone angle is seventeen degrees (17°).

Figure 17:
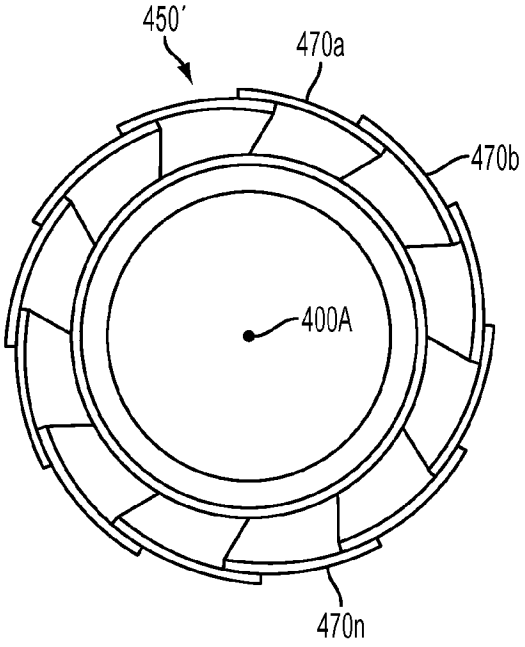
FIG. 17 is aft view of the segmented conical shield shown in FIG. 16.
Figure 16:
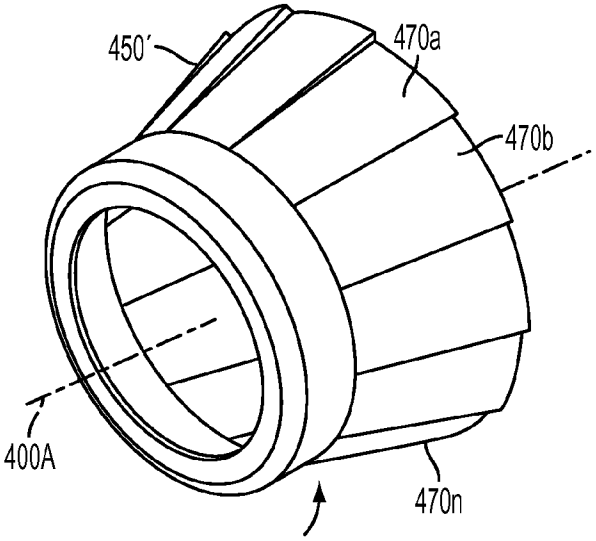
FIG. 16 depicts a perspective view of a segmented conical shield useful for shielding an MCX connector.

FIGS. 16 and 17 depict yet another embodiment of a resilient shield 450' comprising a plurality of overlapping segments 470. More specifically, the resilient shield 450' comprises a plurality of spring-biased segments 470*a*, 470*b*, . . . 470*n* which nest, or overlap, inwardly as the cone angle decreases relative to the axis 400A of the recessed port 405. As the cone angle increases the segments 470*a*, 470*b*, . . . 470*n* open or fan outwardly. To ensure that the resilient shield 450' functions as intended, i.e., a shield which prevents the transmission of RF energy within a prescribed band of frequencies, the segments 470*a*, 470*b*, . . . 470*n* remain at least partially overlapping when fully or completely expanded. The resilient RF shields 450, 450' may be fabricated from a copper material and, in the described embodiment, are composed of a beryllium copper material. Also the shield may be composed of a radar absorbent material to further reduce RF emissions.

In summary, a first embodiment employs a compliant elastomer sleeve disposed about the forward body of the connector to produce an 360 degree RF shield about the circumference of the forward body. The sleeve is conductive (i.e., a metal particulate suspended in a silicone rubber) and conforms to the shape of the recessed port when a coupling device, forward of the resilient sleeve, engages an annular groove at the base of the recessed port. The resilient shield prevents the transmission of RF energy across the sleeve, trapping the RF energy within the recessed port. Furthermore, the compliant elastomer sleeve provides a secondary path for grounding the outer conductor of the coaxial cable.

A second embodiment but includes a compliant metallic cone circumscribing the forward body and diverging outwardly toward the edges of the recessed port. The compliant metallic cone contacts the edge of the port upon axial engagement of the coupling device with the recessed port (i.e., in the same manner as the previous embodiment. The compliant cone provides a 360 degree RF shield about the circumference of the forward body.

Additional embodiments include any one of the embodiments described in the above-identified Exhibits, where one or more of its components, functionalities or structures is interchanged with, replaced by or augmented by one or more of the components, functionalities or structures of a different embodiment described in such Exhibits.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the above-identified Exhibits, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of this disclosure. Moreover, although specific terms are employed herein, they are used only in a generic and descriptive sense, and not for the purposes of limiting the present disclosure.

The following is claimed:

1. A connector for coupling a coaxial cable to a recessed port, comprising:

a first and second end portion, the first end portion disposed at a forward portion of the connector, and the second end portion disposed at an aft portion of the connector, the forward portion configured to engage the recessed port and the aft portion configured to engage a prepared end of the coaxial cable;

the first end portion including a coupling device, an inner conductor engager, a first spool-shaped insulator and second spool shaped insulator, the coupling device including a retention member and a forward body connecting to the retention member, the retention member including a plurality of spring biased retention fingers configured to engage an electrical contact of the recessed port, the forward body connecting to the retention fingers of the coupling device at one end and having an aft opening at an opposite end, the forward body operative to:

(i) center the inner conductor engager, and (ii) mechanically and electrically connect the retention fingers to the coaxial cable;

the inner conductor engager configured to receive the inner conductor of the coaxial cable, and the first and second spool-shaped insulators defining first and second aligned apertures, respectively, for centering the inner conductor engager within an opening of the forward body;

a second end portion including an outer conductor engager, an outer body disposed over an aft portion of the outer conductor engager, and a compression cap slidable over the outer body;

the outer conductor engager having an aft end configured to receive the prepared end of the coaxial cable and a forward end configured to connect to the aft; opening of the forward body;

the outer body disposed over an end of the outer conductor engager to form an annular cavity configured to accept the prepared end of a coaxial cable;

the compression cap disposed over the prepared end of the coaxial cable and operative to compress the outer body against an outer conductor and an outer conductor to produce a mechanical and electrical connection between the coaxial cable and the outer conductor engager; and a resilient radio frequency shield configured to be connected to the forward body, spaced away from the retention member, conform to a surface of the recessed port upon axial engagement of the coupling device with the recessed port, form an electrical connection with a conductive inner surface of the recessed port, prevent transmission of radio frequency energy from an internal or external source, and produce an axial bias maintaining contact between the spring biased retention fingers of the retention member and the electrical contact of the recessed port.

2. The connector of claim 1, wherein the forward body, furthermore, produces a circumferential step between a first region and a second region of the forward body, the first region defining a first diameter dimension which is less than a second diameter dimension of the second region, and at least one directional ridge disposed about an outer cylindrical surface of the forward body; and wherein the resilient radio frequency shield is a compliant, electrically conductive elastomer sleeve comprising a nickel/graphite-filled silicone elastomer having a loading density of between approximately 2.0 $g/cm^3$ to approximately 2.4 $g/cm^3$·t, the resilient radio frequency shield forming a continuous annular body about the forward body.

3. The connector of claim 1, wherein the resilient radio frequency shield is a conductive cone having a ring portion circumscribing the forward body and a cone portion conforming to a portion of the recessed port, the cone portion diverging outwardly in a radial direction from the axis of the outer conductor engager, the conductive cone portion defining a cone angle which diverges outwardly at an angle of between about 15 degrees to about 25 degrees relative to an axis of the outer conductor engager, the cone forming a continuous frustoconical member about the forward body.

4. A connector, comprising:

inner and outer conductor engagers configured to engage the inner and outer conductors, respectively, of a coaxial cable, the outer conductor engager having an aperture for accepting an inner conductor along an axis;

a coupling device including a retention member and a forward body, the retention member engaging an electrical contact disposed within a recessed port, and the forward body configured to: (i) center the inner conductor engager, and (ii) mechanically and electrically connect the retention member to an end of the outer conductor engager; and a resilient radio frequency shield spaced away from the retention member and configured to at least partially encircle the forward body, prevent ingress of radio frequency transmissions from an adjacent recessed port, and prevent egress of radio frequency transmissions to an adjacent recessed port when the coupling device is connected with the recessed port.

5. The connector of claim 4, wherein the recessed port includes a recess defining an annular groove and wherein the coupling device includes a plurality of resilient fingers which are biased outwardly in a radial direction to engage the annular groove upon axial engagement of the recessed port.

6. The connector of claim 4, wherein the forward body defines a circumferential step operative to abut an edge of the resilient radio frequency shield during installation, the circumferential step retarding axial motion of the resilient shield during installation and promoting radial motion to electrically seal the resilient shield against the recessed port.

7. The connector of claim 4, wherein the resilient radio frequency shield is a compliant, electrically conductive, elastomer sleeve.

8. The connector of claim 7, wherein the elastomer sleeve forms a continuous member about the forward body and comprises a nickel/graphite-filled silicone elastomer having a loading density of between approximately 2.0 g/cm$^3$ to approximately 2.4 g/cm$^3$.

9. The connector of claim 8, wherein the elastomer sleeve comprises a resistivity of approximately 0.10 ohm-cm to approximately 0.06 ohm-cm.

10. The connector of claim 4, wherein the resilient radio frequency shield comprises a conductive cone having a ring portion engaging a first portion of the outer conductor engager and a conductive cone portion diverging outwardly in a radial direction from the axis of the outer conductor engager.

11. The connector of claim 10, wherein the conductive cone portion is continuous about the forward body and defines a cone angle, the cone angle diverging outwardly at an angle of between about 15 degrees to about 25 degrees relative to the axis of the outer conductor engager.

12. The connector of claim 11, wherein the resilient radio frequency shield comprises a plurality of spring-biased nesting segments which variably overlap depending upon an angular position of each segment relative to the axis of the port.

13. A connector for connecting a coaxial cable to a recessed port, comprising:

inner and outer conductor engagers configured to engage the inner and outer conductors, respectively, of a coaxial cable, the outer conductor engager having an aperture for accepting an inner conductor along an axis;

a coupling device including a retention member and a forward body, the retention member configured to engage an electrical contact disposed within the recessed port, and the forward body configured to: (i) center the inner conductor engager, and (ii) mechanically and electrically connect to an end of the outer conductor engager; and a resilient radio frequency shield spaced away from the retention member and configured to be connected to the forward body, conform to a surface of the recessed port, axially bias the forward body in a direction so as to promote electrical contact between the coupling device and the recessed port, prevent ingress of radio frequency transmissions from an adjacent recessed port, and prevent egress of radio frequency transmissions to an adjacent recessed port during operation.

14. The connector of claim 13, wherein the forward body defines a circumferential step operative to abut an edge of the resilient radio frequency shield during installation, the circumferential step retarding axial motion of the resilient shield during installation and promoting radial motion to electrically seal the resilient shield against the recessed port.

15. The connector of claim 13, wherein the resilient radio frequency shield is a compliant, electrically conductive elastomer sleeve.

16. The connector of claim 15, wherein the elastomer sleeve forms a continuous member about the forward body and comprises a nickel/graphite-filled silicone elastomer having a loading density of between approximately 2.0 g/cm$^3$ to approximately 2.4 g/cm$^3$.

17. The connector of claim 16, wherein the elastomer sleeve comprises a resistivity of approximately 0.10 ohm-cm to approximately 0.06 ohm-cm.

18. The connector of claim 13, wherein the resilient radio frequency shield comprises a conductive cone having a ring portion engaging a first portion of the outer conductor engager and a cone portion diverging outwardly in a radial direction from the axis of the outer conductor engager.

19. The connector of claim 18, wherein the cone portion is continuous about the forward body and defines a cone angle, the cone angle diverging outwardly at an angle of between about 15 degrees to about 25 degrees relative to the axis of the outer conductor engager.

20. The connector of claim 19, wherein the resilient radio frequency shield comprises a plurality of spring-biased nesting segments which variably overlap depending upon an angular position of each segment relative to the axis of the port.

21. The connector of claim 4, wherein the retention member comprises a plurality of resilient fingers engaging an annular groove in the recessed port.

22. The connector of claim 13, wherein the retention member comprises a plurality of resilient fingers engaging an annular groove in the recessed port.

23. An RF shielding device for electrically isolating RF signals within a recessed port of a MicroCoaXial (MCX) cable connector, comprising:

a coupling device configured to engage the recessed port, the coupling device comprising, a body including a forward end portion and an aft end portion, a portion of the forward end portion configured to face and engage a socket of a recessed port, the aft end portion at least partially received within the recessed port, and wherein the aft end portion is mechanically and electrically coupled to an end of a connector body; and a compliant conductive sleeve configured to circumscribe, and be axially retained by the body and spaced away from the socket of the recessed port, the compliant conductive sleeve being configured to be deformed so as to conform to an interior surface of the recessed port upon engagement of the coupling device within the recessed port, and wherein deformation of the compliant conductive sleeve biases the coupling device and the body so as to promote electrical contact with the recessed port during operation.

24. The RF shielding device of claim 23, wherein the forward body includes a step defined by a change in diameter from the forward to the aft end portions of the body, the step axially retaining the conductive sleeve in one direction upon engagement with the recessed port.

25. The RF shielding device of claim 23, wherein the compliant conductive sleeve comprises a conductive cone diverging outwardly in a radial direction from an elongate axis of the connector body.

26. The RF shielding device of claim 25, wherein the conductive cone defines a cone angle diverging outwardly at an angle of between about 15 degrees to about 25 degrees relative to the elongate axis of the connector body.

27. The RF shielding device of claim 24, wherein the body includes at least one radially-protruding directional ridge operative to axially retain the compliant conductive sleeve from axial movement in another direction upon disengagement with the recessed port.

28. The RF shielding device of claim 27, wherein the compliant conductive sleeve is loaded with a conductive particulate, and wherein the at least one radially-protruding directional ridge is operative to concentrate the conductive particulate to augment RF shielding properties within a selective frequency band.

29. The RF shielding device of claim 27, wherein the compliant conductive sleeve comprises a nickel/graphite-filled silicone elastomer having a loading density of between approximately 2.0 g/cm$^3$ to approximately 2.4 g/cm$^3$.

30. The RF shielding device of claim 29, wherein the silicone elastomer comprises a resistivity of approximately 0.10 ohm-cm to approximately 0.06 ohm-cm.

31. A shielded connection for coupling an RF connector to an interface port, comprising:

a recessed interface port having a cavity defining an interior surface; and an RF shielding device for electrically isolating RF signals within the recessed port, comprising:

a coupling device configured to engage the recessed interface port, the coupling device comprising, a forward body including a forward end portion and an aft end portion, a portion of the forward end portion configured to face and engage a socket of a recessed port, the aft end portion at least partially received within the recessed interface port, and wherein the aft end portion is mechanically and electrically coupled to an end of a connector body; and a compliant conductive sleeve spaced away from the socket of the recessed port and configured to circumscribe, and be axially retained by the forward body, and conform to an interior surface of the recessed interface port so as to prevent ingress of radio frequency transmissions from an adjacent recessed port, and prevent egress of radio frequency transmissions to an adjacent recessed port during operation.

32. The shielded connection of claim 31, wherein the forward body includes a step defined by a change in diameter from the forward to the aft end portions of the forward body, the step axially retaining the compliant conductive sleeve in one direction upon engagement with the recessed port.

33. The shielded connection of claim 31, wherein the compliant conductive sleeve comprises a conductive cone diverging outwardly in a radial direction from an elongate axis of the connector body.

34. The shielded connection of claim 33, wherein the conductive cone defines a cone angle diverging outwardly at an angle of between about 15 degrees to about 25 degrees relative to the elongate axis of the connector body.

35. The shielded connection of claim 32, wherein the forward body includes at least one radially-protruding directional ridge operative to axially retain the compliant conductive sleeve from axial movement in another direction upon disengagement with the recessed port.

36. The shielded connection of claim 35, wherein the compliant conductive sleeve is loaded with a conductive particulate, and wherein the at least one radially-protruding directional ridge is operative to concentrate the conductive particulate to augment RF shielding properties within a selective frequency band.

37. The shielded connection of claim 35, wherein the compliant conductive sleeve comprises a nickel/graphite-filled silicone elastomer having a loading density of between approximately 2.0 g/cm$^3$ to approximately 2.4 g/cm$^3$.

38. The shielded connection of claim 36, wherein the compliant conductive sleeve comprises a resistivity of approximately 0.10 ohm-cm to approximately 0.06 ohm-cm.

39. A connector for coupling a coaxial cable to a recessed port, the connector comprising:

a body including a forward end portion and an aft end portion, the forward end portion having a forward body, a portion of the forward body configured to engage a lower receptacle of a recessed port, the aft end portion is mechanically and electrically connected to the forward end portion, and wherein the aft end portion is disposed away from the portion of the forward body; and a compliant conductive sleeve configured to surround, and be axially retained by the forward end portion of the body and spaced away from the portion of the forward body, wherein a seal is formed to mitigate leakage of RF energy by filling in and closing gaps at the inner surface of the upper receptacle of the recessed port and the compliant conductive sleeve.

40. The connector of claim 39 wherein the compliant conductive sleeve is configured to be deformed so as to conform to an interior surface of an upper receptacle of the recessed port upon engagement with the recessed port at the portion of the forward body, and wherein deformation of the compliant conductive sleeve promotes electrical contact with the interior surface of the upper receptacle of the recessed port.

41. The connector of claim 39, wherein the deformation of the compliant conductive sleeve against an inner surface of the upper receptacle of the recessed port produces an axial bias to maintain electrical connection between the portion of the forward body and the lower receptacle.

42. The connector of claim 39, wherein deformation of the compliant conductive sleeve during operation promotes electrical contact with an interior surface of upper receptacles of recessed ports of various sizes.

43. The connector of claim 39, wherein the forward end portion further comprises one or more directional ridges configured to facilitate movement of the compliant conductive sleeve toward the aft end portion of the body.

44. The connector of claim 39, wherein the portion of the forward body comprises a plurality of resilient fingers configured to contact and retain a portion of the recessed port.

45. A connector for coupling a coaxial cable to a recessed port, the connector comprising:

a body including a forward end portion and an aft end portion, the forward end portion having a forward body, a portion of the forward body configured to engage a lower receptacle of a recessed port, the aft end portion is mechanically and electrically connected to the forward end portion, and wherein the aft end portion is disposed away from the portion of the forward body; and a compliant conductive sleeve configured to surround, and be axially retained by the forward end portion of the body, wherein the compliant conductive sleeve is configured to be deformed so as to conform to an interior surface of an upper receptacle of the recessed port upon engagement with the recessed port at the portion of the forward body, and wherein deformation of the compliant conductive sleeve promotes electrical contact with the interior surface of the upper receptacle of the recessed port;

wherein a seal is formed to mitigate leakage of RF energy by filling in and closing gaps at the inner surface of the upper receptacle of the recessed port and the compliant conductive sleeve.

46. The connector of claim 45, wherein the deformation of the compliant conductive sleeve against an inner surface of the upper receptacle of the recessed port produces an axial bias to maintain electrical connection between the portion of the forward body and the lower receptacle.

47. The connector of claim 45, wherein deformation of the compliant conductive sleeve during operation promotes electrical contact with an interior surface of upper receptacles of recessed ports of various sizes.

48. The connector of claim 45, wherein the forward end portion further comprises one or more directional ridges configured to facilitate movement of the compliant conductive sleeve toward the aft end portion of the body.

49. The connector of claim 45, wherein the portion of the forward body comprises a plurality of resilient fingers configured to contact and retain a portion of the recessed port.

* * * * *